US007090704B2

(12) United States Patent
Ouziel

(10) Patent No.: US 7,090,704 B2
(45) Date of Patent: Aug. 15, 2006

(54) METHOD OF TREATING NATURAL OR SYNTHETIC POLYAMIDE FIBRE MATERIALS

(75) Inventor: Philippe Ouziel, Altkirch (FR)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 245 days.

(21) Appl. No.: 10/497,364

(22) PCT Filed: Nov. 26, 2002

(86) PCT No.: PCT/EP02/13291

§ 371 (c)(1),
(2), (4) Date: Jun. 2, 2004

(87) PCT Pub. No.: WO03/048446

PCT Pub. Date: Jun. 12, 2003

(65) Prior Publication Data

US 2005/0076452 A1 Apr. 14, 2005

(30) Foreign Application Priority Data

Dec. 5, 2001 (EP) ..... 01811182

(51) Int. Cl.
*D06P 1/52* (2006.01)

(52) U.S. Cl. ..... 8/557; 8/924; 8/930; 8/495

(58) Field of Classification Search ..... 8/557, 8/924, 930, 495
See application file for complete search history.

(56) References Cited

U.S. PATENT DOCUMENTS

| | | | | |
|---|---|---|---|---|
| 4,070,152 | A | 1/1978 | Pentz | 8/115.6 |
| 4,693,727 | A | 9/1987 | Bowles et al. | 8/549 |
| 5,948,125 | A | 9/1999 | Ouziel | 8/552 |
| 6,280,482 | B1 | 8/2001 | Ouziel et al. | 8/490 |
| 6,280,648 | B1 * | 8/2001 | Konzelman et al. | 252/8.61 |

* cited by examiner

*Primary Examiner*—Margaret Einsmann
*Assistant Examiner*—Amina Khan
(74) *Attorney, Agent, or Firm*—Kevin T. Mansfield

(57) ABSTRACT

A method of improving the resistance of dyes on natural or synthetic polyamnide fiber materials to the action of ozone and $NO_x$, which comprises treating the fiber material, before, during or after dyeing, with a liquor comprising a terpolymer containing structural repeating units of formulae (I), (II) and (III) in which R is a radical of formula (IV) wherein $A_1$ and $A_2$ are independently of one another a direct bond, $C_1$–$C_8$alkylene or —CO—NH—$C_1$–$C_8$alkylene, E is vinyl or —$OSH_3H$ and n denotes 0 or 1. The dyeings and prints obtained are distinguished by improved ozone fastness properties without the shade, color yield and other fastness properties, for example fastness to light, being affected (I)

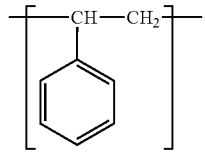

(II)

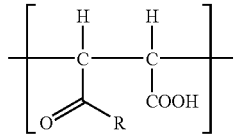

(III)

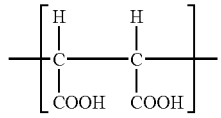

(IV)

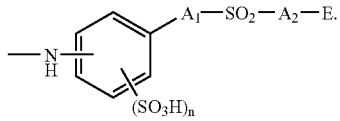

12 Claims, No Drawings

METHOD OF TREATING NATURAL OR SYNTHETIC POLYAMIDE FIBRE MATERIALS

The present invention relates to a method of treating natural or synthetic polyamide fibre materials in order to the improve the resistance of dyes to the action of ozone and $NO_x$.

Dyeings and prints obtained using dyes often exhibit a high level of sensitivity to ozone and nitrogen oxides. For example, anthraquinone dyes are readily oxidatively degraded by ozone, resulting in a change in their absorption properties, and hence the colour. Such behaviour is observed especially with blue anthraquinone dyes. The shade of a trichromatic dyeing based on blue anthraquinone dyes, for example a woven polyamide carpet fabric, is readily changed by the action of ozone. Such a drawback is generally tackled by treating the dyed polyamide fibre material with resins based on condensates of phenol and formaldehyde. The known compositions for improving resistance to ozone, however, have drawbacks: for example they lack effectiveness or have an adverse effect on other fastness properties, for example fastness to light. There is therefore a need, in the treatment of natural or synthetic polyamide fibre materials dyed especially with anionic dyes, for improved compositions for increasing resistance to ozone that do not have the drawbacks mentioned.

According to the method described in U.S. Pat. No. 6,280,482, the resistance to ozone of dyeings of anionic dyes on polyamide fibres can be appreciably improved by treatment with solutions of homo- or co-polymers based on acrylic acid or methacrylic acid.

It has now been found that the resistance of dyeings on polyamide fibre material can be improved without adversely affecting other fastness properties by subjecting them to treatment with particular styrene/maleic anhydride terpolymers.

The present invention relates to a method of improving the resistance of dyes on natural or synthetic polyamide fibre materials to the action of ozone and $NO_x$, which method comprises treating the fibre material, before, during or after dyeing, with a liquor comprising a terpolymer containing structural repeating units of formulae (I), (II) and (III)

(I)

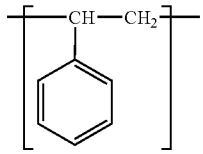

(II)

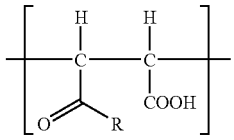

(III)

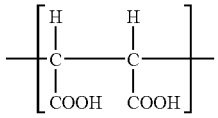

in which R is a radical of formula (IV)

(IV)

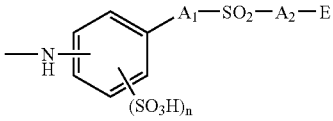

wherein $A_1$ and $A_2$ are independently of one another a direct bond, $C_1$–$C_8$alkylene or —CO—NH—$C_1$–$C_8$alkylene, E is vinyl or —$OSO_3H$ and n denotes 0 or 1.

It will be understood that, instead of using terpolymers containing structural repeating units of formulae (I), (II) and (III) having free acid groups, it is also possible to use corresponding salts, that is to say, terpolymers having COOM groups, M being an alkali metal or ammonium.

$C_1$–$C_8$Alkylene radicals include, for example, methylene, ethylene, propylene, trimethylene, tetramethylene, propylidene, isopropylidene, hexamethylene and octamethylene.

$A_1$ and $A_2$ are preferably a direct bond or ethylene.

In the method according to the invention, preference is given to the use of terpolymers containing structural repeating units of formula (II) in which R is a radical of formula (IVa) to (IVf)

(IVa)

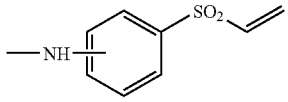

(IVb)

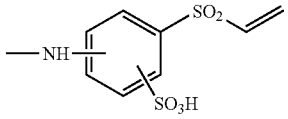

(IVc)

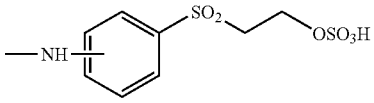

(IVd)

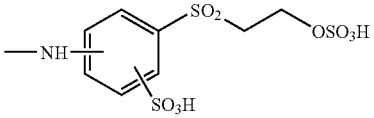

(IVe)

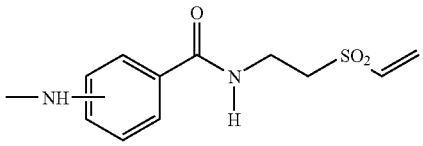

(IVf)

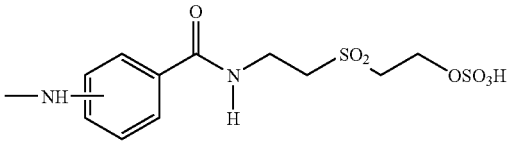

Especially preferred terpolymers contain structural repeating units of formula (II) in which R is a radical of formula (IVg) to (IVi)

(IVg)

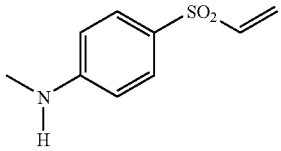

(IVh)

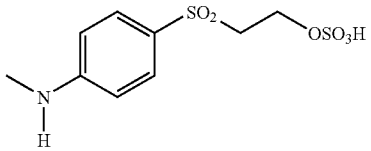

(IVi)

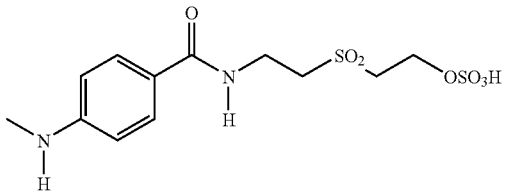

In the terpolymers used in accordance the invention as means for improving ozone resistance, the quantitative ratio of the structural units of formulae (I), (II) and (III) can vary within wide limits.

Preferably, the terpolymers contain from 30 to 70 mol %, especially from 40 to 60 mol % and more especially from 45 to 55 mol %, of structural repeating units of formula (I), from 1 to 30 mol %, especially from 7.5 to 25 mol % and more especially from 10 to 20 mol %, of structural repeating units of formula (II) and from 15 to 50 mol %, especially from 25 to 45 mol % and more especially from 30 to 40 mol %, of structural repeating units of formula (III).

The terpolymers for use in the method according to the invention may, in addition to containing the structural repeating units of formulae (I), (II) and (III), contain further structural repeating units derived from free-radical-polymerisable monomers.

Suitable free-radical-polymerisable monomers include, for example, acrylic acid, fumaric acid, itaconic acid, mesaconic acid, citraconic acid, vinylacetic acid, vinyloxyacetic acid, vinylpropionic acid, crotonic acid, aconitic acid, allylacetic acid, allyloxyacetic acid, α,β-dimethylacrylic acid, allylmalonic acid, allyloxymalonic acid, methylenemalonic acid, glutaconic acid, β-carboxyethyl acrylate, allyloxy-3-hydroxybutanoic acid, allylsuccinic acid, acrylamidoglycolic acid, vinylsulfonic acid, (meth)allylsulfonic acid, (meth)acrylamidomethylpropanesulfonic acid, (meth)acrylamidopropanesulfonic acid, (meth)acrylamidoethanesulfonic acid, (meth)acrylamidomethanesulfonic acid, sulfopropyl (meth)acrylate, styrenesulfonic acid, vinylcaprolactam, diallylamine, N-methyldiallylamine, N-ethyldiallylamine, N-vinylpyrrolidone, N-vinylformamide, N-vinylacetamide, N-vinyl-N-methylformamide, N-vinyl-N-methylacetamide, N-vinyl-N-ethylacetamide, N-vinylimidazole, N-vinyl-N-methylimidazole, N-vinylimidazoline, N-vinyl-2-methylimidazoline, N-vinylcaprolactam, vinyl acetate, vinyl propionate, vinyl butyrate, $C_1$–$C_{22}$alkyl vinyl ketone, $C_1$–$C_{22}$alkyl vinyl ether, olefins, for example ethylene, propylene, isobutene, styrene or derivatives thereof, for example hydroxystyrene, 1,2-dimethoxyethylene, hydroxy-$C_2$–$C_4$alkyl (meth)acrylate, (meth)acrylic $C_1$–$C_{22}$alkyl ester, (meth)acrolein, (meth) acrylonitrile, (meth)acrylamide, N-mono/N,N-di-$C_1$–$C_{10}$alkyl (meth)acrylamide, ($C_1$–$C_4$)alkoxy (meth)acrylates, N,N-di-$C_1$–$C_2$alkylamino-$C_1$–$C_4$alkyl (meth) acrylates, and unsaturated acetals, ketals and orthocarboxylic acid esters, for example 2,5-dimethoxy-2,5-dihydrofuran or 2-methoxy-3,4-dihydro-2H-pyran.

It is also possible to use mixtures of a plurality of terpolymers in the method according to the invention.

The terpolymers used in the method according to the invention have an average molecular weight (weight average $M_w$) of from 1000 to 70 000, preferably from 1200 to 20 000 and especially from 1500 to 10 000.

The terpolymers containing structural repeating units of the above formulae (I), (II) and (III) used in accordance with the invention as means for improving resistance to ozone and $NO_x$ are prepared in a manner known per se.

Preferably, SMA copolymers (styrene/maleic anhydride copolymers) are used as starting materials; such copolymers are easy to produce and are also available commercially. A terpolymer containing structural repeating units of formulae (I), (II) and (III) is obtained by reacting a SMA copolymer with an aniline of formula (V)

(V)

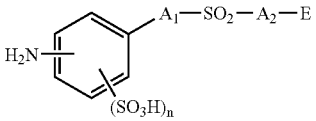

wherein $A_1$, $A_2$, E and n are as defined hereinbefore.

Irrespective of the liquor ratio, the terpolymers used in the method according to the invention are employed, for example, in an amount of from 0.05 to 10% by weight, especially from 0.1 to 6% by weight and more especially from 0.5 to 4% by weight, based on the weight of the polyamide fibre material.

Treatment of the polyamide fibre material with the terpolymers used in accordance with the invention can be carried out before, during or after the dyeing operation, preferably during or after the dyeing operation.

When treatment of the polyamide fibre material with the terpolymers used in accordance with the invention is performed during the dyeing operation, the method according to the invention is advantageously carried out by adding the polymers in the above-indicated amount to the dye liquor and dyeing the fibre material in the usual manner.

When treatment of the polyamide fibre material with the terpolymers used in accordance with the invention is performed after the dyeing operation, the method according to the invention is advantageously carried out by first dyeing the polyamide fibre material in the usual manner and then carrying out an aftertreatment with a fresh aqueous liquor containing the polymers in the above-indicated amount. Water can then be removed from the dyed polyamide fibre material without a further rinsing operation, and the material can be dried in the usual manner. The aftertreatment is usually carried out in fresh liquor. It can, however, also be carried out directly in the dye bath provided that, at the end, the dye bath is substantially exhausted and is still adequately acidic. Following the treatment, a brief cold rinse with water is generally carried out.

Suitable polyamide fibre materials include natural polyamide fibre material, for example wool or silk, synthetic polyamide fibre material, for example polyamide 6 or polyamide 6,6, and fibre mixtures, for example wool/cellulose, polyamide/cellulose or polyamide/wool blends. The fibre material is preferably synthetic polyamide fibre material.

The textile goods can be used in any form, for example in the form of fibres, yarn, woven fabric or knitted fabric.

The dyeings are carried out, for example, with anionic dyes, any customary anionic dye, as described, for example, in the Colour Index, 3rd Edition (1971) and the appendices thereto under the headings "Acid Dyes", being suitable.

Examples include sulfo group-containing monoazo, polyazo, metal complex azo, anthraquinone, phthalocyanine and formazan dyes.

Preferably, the dyeings are carried out with anthraquinone dyes and especially with blue anthraquinone dyes.

The anionic dyes used for dyeing the polyamide fibre material are either in the form of their free sulfonic acid or, preferably, in the form of a salt thereof.

As salts there come into consideration, for example, alkali metal, alkaline earth metal and ammonium salts and the salts of an organic amine. Sodium, lithium, potassium and ammonium salts and the salts of mono-, di- and tri-ethanolamine may be mentioned as examples.

The anionic dyes used for dyeing the polyamide fibre material may comprise further additives, for example sodium chloride or dextrin.

The polyamide fibre material can be dyed with anionic dyes according to the dyeing and printing methods customary for such dyes, for example according to the exhaust method. The dye liquors or printing pastes may, in addition to comprising water and the dyes, comprise further ingredients, for example wetting agents, antifoams, levelling agents, or substances that influence the characteristics of the textile material, for example softeners, flame retardants or dirt-, water- and oil-repellents as well as water softeners and natural or synthetic thickeners, for example alginates and cellulose ethers.

The amounts in which anionic dyes are used in the dye baths or printing pastes may vary within wide limits depending on the desired depth of shade; amounts of from 0.01 to 15% by weight, especially from 0.01 to 10% by weight, based on the goods to be dyed or the printing paste, have generally proved advantageous.

Dyeing with anionic dyes in the presence of the terpolymers used in accordance with the invention is preferably carried out a pH value of from 2 to 9 and especially from 4 to 7. The liquor ratio selected can vary within a wide range, for example from 1:5 to 1:50, preferably from 1:5 to 1:30.

Dyeing in the presence of the terpolymers used in accordance with the invention is preferably carried out at from 50 to 100° C. and especially from 80 to 100° C.

Aftertreatment with the terpolymers used in accordance with the invention is carried out preferably according to the padding method, or especially according to the exhaust method. The liquor ratio selected can vary within a wide range and is, for example, from 1:4 to 1:100, preferably from 1:10 to 1:40 and especially from 1:5 to 1:40.

Special apparatus is not required. For example conventional dyeing apparatus, e.g. open baths, winch backs, jigs, or paddle dyeing, jet dyeing or circulation dyeing apparatus may be used.

The procedure is advantageously carried out at a temperature of, for example, from 20 to 100° C., especially from 50 to 100° C. and more especially from 60 to 100° C. The treatment time may be, for example, from 10 to 60 minutes and preferably from 15 to 40 minutes. The pH value of the liquor is generally from 2 to 9, especially from 4 to 7 and more especially from 4 to 6.

In addition to comprising the fixing agent, the liquor may also comprise further customary additives, such as electrolytes, for example sodium chloride or sodium sulfate, dispersants and wetting agents, acid donors and antifoams.

The dyeings or prints from dyes, for example anionic dyes, on polyamide fibre material obtained in accordance with the method according to the invention exhibit an appreciable improvement in fastness to ozone and $NO_x$ without the colour yield, shade or the light fastness properties being adversely affected.

The following Examples serve to illustrate the invention. Unless specified otherwise, temperatures are in degrees Celsius, parts are parts by weight and percentages are percentages by weight. Parts by weight relate to parts by volume in a ratio of kilograms to litres.

PREPARATION EXAMPLES

Example 1

In a 350 ml sulfonating flask, 23.2 g of SMA® 1000 (copolymer of maleic anhydride and styrene from Atofina having an average molecular weight of 1500–2000), 80 ml of dimethylformamide and 5 drops of tributylamine are heated to 85° C. 7.4 g of 2-[(4-aminophenyl)sulfonyl]ethyl hydrogen sulfate are added to the resulting solution. After reaction for 5 hours at 85° C., the polymer is precipitated from ethanol, filtered off and dried. 22 g of a polymer containing 50 mol % of structural repeating units of formula (I), 12.5 mol % of structural repeating units of formula (II) wherein R is a radical of formula (IVh), and 37.5 mol % of structural repeating units of formula (III) are obtained.

Example 2

In a 350 ml sulfonating flask, 23.2 g of SMA® 1000 (copolymer of maleic anhydride and styrene from Atofina), 80 ml of dimethylformamide and 5 drops of tributylamine are heated to 85° C. 10.4 g of 2-[(4-aminophenyl)sulfonyl] ethyl hydrogen sulfate are added to the resulting solution. After reaction for 5 hours at 85° C., the polymer is precipitated from ethanol, filtered off and dried. 21 g of a polymer containing 50 mol % of structural repeating units of formula (I), 17.5 mol % of structural repeating units of formula (II) wherein R is a radical of formula (IVh), and 32.5 mol % of structural repeating units of formula (III) are obtained.

Example 3

In a 350 ml sulfonating flask, 23.2 g of SMA® 1000 (copolymer of maleic anhydride and styrene from Atofina), 80 ml of dimethylformamide and 5 drops of tributylamine are heated to 85° C. 9.4 g of 4-aminobenzoic acid [2-[2-(sulfooxy)ethyl]sulfonyl]ethylamide are added to the resulting solution. After reaction for 5 hours at 85° C., the polymer is precipitated from ethanol, filtered off and dried. 23.1 g of a polymer containing 50 mol % of structural repeating units of formula (I), 12.5 mol % of structural repeating units of formula (II) wherein R is a radical of formula (IVi), and 37.5 mol % of structural repeating units of formula (III) are obtained.

Example 4

In a 350 ml sulfonating flask, 23.2 g of SMA® 1000 (copolymer of maleic anhydride and styrene from Atofina), 70 ml of dimethylformamide and 5 drops of tributylamine are heated to 85° C. 4.5 g of 4-aminophenylvinylsulfone are added to the resulting solution. After reaction for 5 hours at 85° C., 10 g of 1N NaOH are slowly added dropwise thereto at room temperature. The polymer first of all precipitates and then redissolves. After the addition of water, the polymer precipitates. The batch is neutralised to pH 5.0, a white suspension being obtained. Some of the water/DMF mixture is distilled off and the solids content is adjusted to 20%. 162 g of a clear solution of a polymer containing 50 mol % of structural repeating units of formula (I), 12.5 mol % of structural repeating units of formula (II) wherein R is a radical of formula (IVg), and 37.5 mol % of structural repeating units of formula (III) are obtained.

Application Examples 1 to 3

A dye liquor is prepared from 0.037 parts by weight of a dye of formula

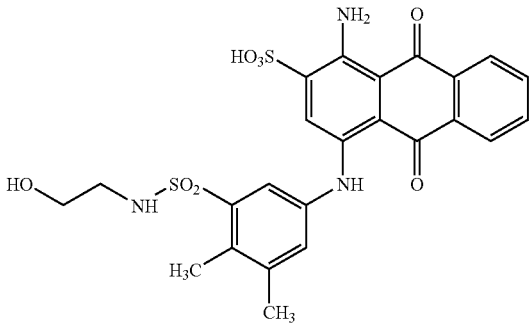

554 parts by weight of water, 15 parts by weight of buffer solution, pH 6.5, and 0.9 parts by weight of Univadin® PA new (levelling agent from Ciba SC). 30 parts by weight of polyamide carpet (PA 6) are introduced into the resulting dye bath at 30° C. The temperature is uniformly increased to boiling point in the course of 45 minutes, and dyeing is then carried out for a further 30 minutes at that temperature. The blue-dyed carpet is subsequently rinsed. The dyed woven carpet fabric is aftertreated for 15 minutes at a temperature of 75° C. in a fresh bath consisting of 560 parts by weight of water, 20 parts by weight of a 3% solution of polymer from Example 1 and 15 parts by weight of buffer solution, pH 4.5. The woven carpet fabric is subsequently rinsed and dried. The fastness properties of the dyeing obtained are measured according to the test specifications ISO 105-G03 (ozone fastness) and ISO 105-G04 ($NO_x$ fastness). Compared with the same dyeing that has not been subjected to the aftertreatment, a distinct increase in resistance to ozone and $NO_x$ is observed.

A blue, ozone- and $NO_x$-resistant dyeing is likewise obtained when 20 parts by weight of a 3% solution of polymer from Example 2 or 3 are used instead of the above-mentioned 20 parts by weight of the solution of polymer from Example 1.

Application Examples 4 to 6

A dye liquor is prepared from 0.031 parts by weight of a dye of formula

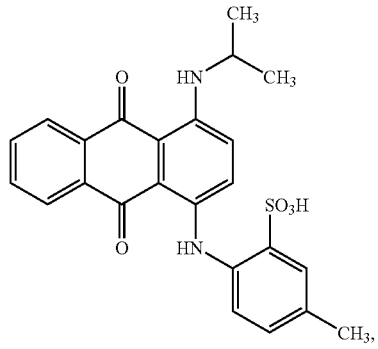

554 parts by weight of water, 20 parts by weight of a 3% solution of polymer from Example 1, 15 parts by weight of buffer solution, pH 5.0, and 0.9 parts by weight of Univadin® PA new (levelling agent from Ciba SC). 30 parts by weight of polyamide carpet (PA 6) are introduced into the resulting dye bath at 30° C. The temperature is uniformly increased to boiling point in the course of 45 minutes, and dyeing is then carried out for a further 30 minutes at that temperature. The blue-dyed carpet is subsequently rinsed and dried. The fastness properties of the dyeing obtained are measured according to the test specifications ISO 105-G03 (ozone fastness) and ISO 105-G04 ($NO_x$ fastness). Compared with the same dyeing that has not been subjected to the aftertreatment, a distinct increase in resistance to ozone and $NO_x$ is observed.

A blue, ozone- and $NO_x$-resistant dyeing is likewise obtained when 20 parts by weight of a 3% solution of polymer from Example 2 or 3 are used instead of the above-mentioned 20 parts by weight of the solution of polymer from Example 1.

Application Examples 7 to 9

A dye liquor is prepared from 0.031 parts by weight of a dye of formula

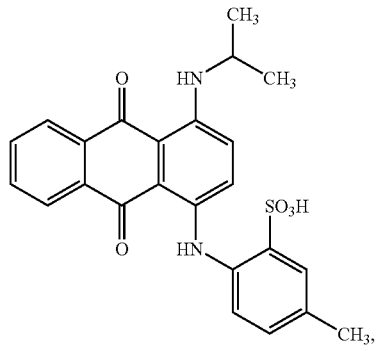

554 parts by weight of water, 20 parts by weight of a 3% solution of polymer from Example 1, 15 parts by weight of buffer solution, pH 7.0, and 2.0 parts by weight of Cibatex® ADN (acid donor from Ciba SC). 30 parts by weight of polyamide carpet (PA 6) are introduced into the resulting dye bath at 30° C. The temperature is uniformly increased to boiling point in the course of 45 minutes, and dyeing is then carried out for a further 30 minutes at that temperature. The blue-dyed carpet is subsequently rinsed and dried. The fastness properties of the dyeing obtained are measured according to the test specifications ISO 105-G03 (ozone fastness) and ISO 105-G04 ($NO_x$ fastness). Compared with the same dyeing that has not been subjected to the after-treatment, a distinct increase in resistance to ozone and $NO_x$ is observed.

A blue, ozone- and $NO_x$-resistant dyeing is likewise obtained when 20 parts by weight of a 3% solution of polymer from Example 2 or 3 are used instead of the above-mentioned 20 parts by weight of the solution of polymer from Example 1.

What is claimed is:

1. A method of improving the resistance of a dye on a natural or synthetic polyamide fibre material to the action of ozone and $NO_x$, which comprises treating the fibre material, before, during or after dyeing, with a liquor comprising a terpolymer containing structural repeating units of formulae (I), (II) and (III)

(I)

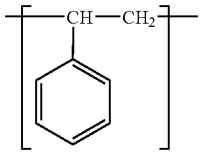

(II)

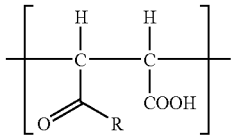

(III)

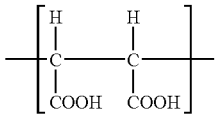

in which R is a radical of formula (IV)

(IV)

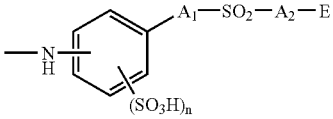

wherein $A_1$ and $A_2$ are independently of one another a direct bond, $C_1$–$C_8$alkylene or —CO—NH—$C_1$–$C_8$alkylene, E is vinyl or —$OSO_3H$ and n denotes 0 or 1.

2. A method according to claim 1, wherein a terpolymer containing structural repeating units of formula (II) is used in which R is a radical of formula (IVa) to (IVf)

(IVa)

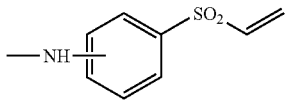

(IVb)

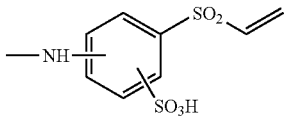

(IVc)

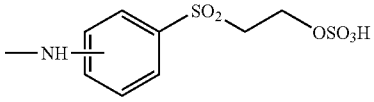

(IVd)

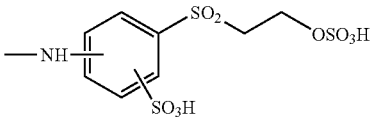

(IVe)

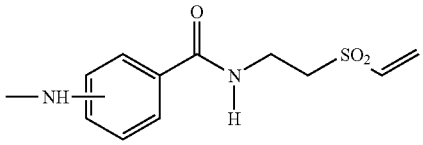

(IVf)

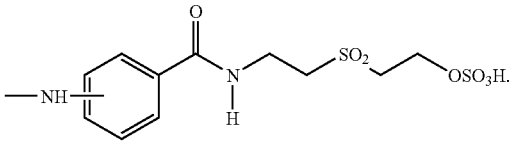

3. A method according to claim 1, wherein a terpolymer containing structural repeating units of formula (II) is used in which R is a radical of formula (IVg) to (IVi)

(IVg)

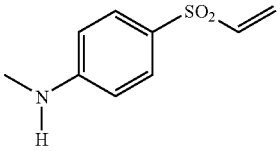

(IVh)

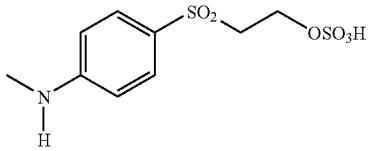

(IVi)

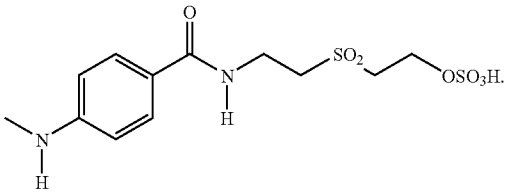

4. A method according to claim 1, wherein the terpolymer contains from 30 to 70 mol % of structural repeating units of formula (I), from 1 to 30 mol % of structural repeating units of formula (II) and from 15 to 50 mol % of structural repeating units of formula (III).

5. A method according to claim 1, wherein the terpolymer has an average molecular weight (weight average $M_w$) of from 1000 to 70,000.

6. A method according to claim 1, wherein the amount of terpolymer present in the liquor is from 0.05 to 10% by weight, based on the weight of the polyamide fibre material.

7. A method according to claim 1, wherein the fibre material is treated during or after the dyeing operation.

8. A method according to claim 7, wherein the treatment with the liquor comprising the terpolymer is carried out at a pH value of from 2 to 9.

9. A method according to claim 7, wherein the treatment with the liquor comprising the terpolymer is carried out at a temperature of from 50 to 100° C.

10. A method according to claim 1, wherein the treatment with the liquor comprising the terpolymer is carried out according to the padding or exhaust method.

11. A method according to claim 1, wherein the fibre material is synthetic polyamide fibre material.

12. A method according to claim 1, wherein the dye is an anthraquinone dye.

* * * * *